US010883328B2

(12) United States Patent
Brandsdal

(10) Patent No.: US 10,883,328 B2
(45) Date of Patent: Jan. 5, 2021

(54) HOLDING AND CRUSHING DEVICE FOR BARRIER PLUG

(71) Applicant: TCO AS, Indre Arna (NO)

(72) Inventor: Viggo Brandsdal, Ytre Arna (NO)

(73) Assignee: TCO AS, Indre Arna (NO)

( * ) Notice: Subject to any disclaimer, the term of this patent is extended or adjusted under 35 U.S.C. 154(b) by 175 days.

(21) Appl. No.: 15/753,633

(22) PCT Filed: Aug. 26, 2016

(86) PCT No.: PCT/NO2016/050177
§ 371 (c)(1),
(2) Date: Feb. 20, 2018

(87) PCT Pub. No.: WO2017/034416
PCT Pub. Date: Mar. 2, 2017

(65) Prior Publication Data

US 2018/0245421 A1 Aug. 30, 2018

(30) Foreign Application Priority Data

Aug. 27, 2015 (NO) ..... 20151095

(51) Int. Cl.

| | |
|---|---|
| ***E21B 29/00*** | (2006.01) |
| ***E21B 33/134*** | (2006.01) |
| ***E21B 33/12*** | (2006.01) |
| ***E21B 29/02*** | (2006.01) |

(52) U.S. Cl.
CPC ..... *E21B 29/00* (2013.01); *E21B 29/02* (2013.01); *E21B 33/1204* (2013.01); *E21B 33/1208* (2013.01); *E21B 33/134* (2013.01)

(58) Field of Classification Search
CPC ..... E21B 29/02; E21B 29/00; E21B 33/12
See application file for complete search history.

(56) References Cited

U.S. PATENT DOCUMENTS

| | | | | |
|---|---|---|---|---|
| 5,479,986 | A * | 1/1996 | Gano | E21B 23/00 166/292 |
| 7,712,521 | B2 | 5/2010 | Sorensen | |
| 9,732,579 | B2 * | 8/2017 | Hiorth | E21B 33/1208 |
| 2009/0101358 | A1 | 4/2009 | Bjorgum | |

(Continued)

FOREIGN PATENT DOCUMENTS

| | | |
|---|---|---|
| EP | 0 681 087 A2 | 11/1995 |
| NO | 321976 B1 | 7/2006 |

(Continued)

OTHER PUBLICATIONS

International Search Report, dated Jan. 25, 2017, from corresponding PCT/NO2016/050177 application.

*Primary Examiner* — Tara Schimpf
(74) *Attorney, Agent, or Firm* — Flener IP & Business Law; Zareefa B. Flener

(57) ABSTRACT

Disclosed is a plug arrangement including glass arranged in one or more seats in a plug housing, the seat or seats forming support members supporting the glass or glasses in an axial direction. At least one of the support members includes an axially displaceable split sleeve which, in one direction, includes a support ring/face abutting against the glass, and in the other direction a number of split sleeve arms arranged to rest against an edge arranged in the plug housing.

27 Claims, 5 Drawing Sheets

(56) References Cited

U.S. PATENT DOCUMENTS

Figure 1:
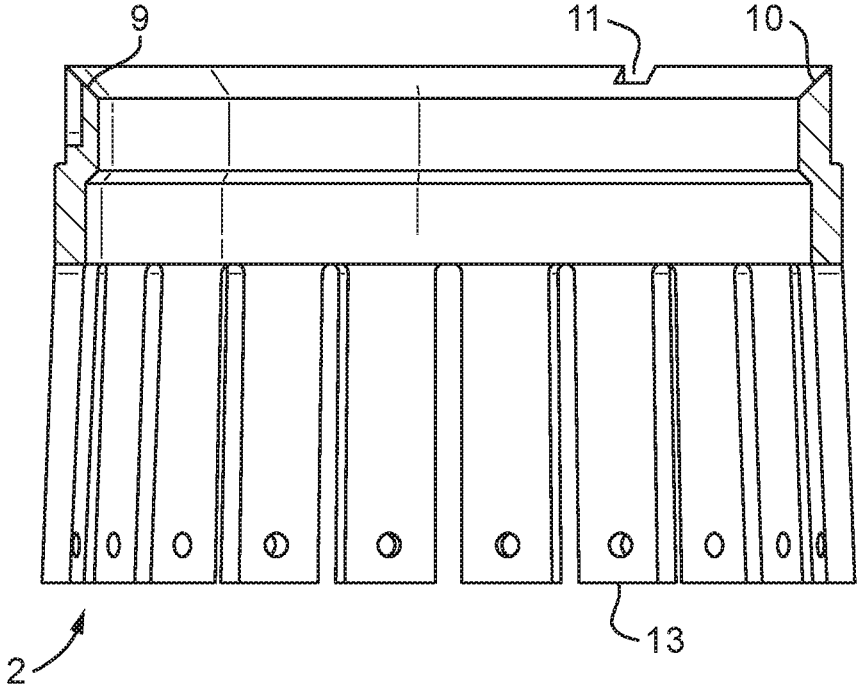

| | | | | |
|---|---|---|---|---|
| 2011/0000663 | A1* | 1/2011 | Brandsdal | E21B 33/12 166/178 |
| 2011/0000676 | A1 | 1/2011 | Brandsdal | |
| 2012/0261115 | A1 | 10/2012 | Xu | |
| 2013/0300066 | A1 | 11/2013 | Xu et al. | |

FOREIGN PATENT DOCUMENTS

| | | | |
|---|---|---|---|
| NO | 325431 | B1 | 4/2008 |
| NO | 20081229 | A | 9/2009 |
| NO | 328577 | B1 | 3/2010 |
| NO | 331150 | B1 | 10/2011 |
| WO | 2009/110805 | A1 | 9/2009 |
| WO | 2009/116871 | A1 | 9/2009 |
| WO | 2014/154464 | A2 | 10/2014 |

* cited by examiner

HOLDING AND CRUSHING DEVICE FOR BARRIER PLUG

The present invention relates to a holding and crushing device for a barrier plug in hydrocarbon wells, the plug comprising a crushable material of glass.

Wells for oil and gas production are often exposed to very high pressures which arise from a combination of the ambient pressure in the well (due to the depth) and the reservoir pressure exerted of the actual oil and gas. It is therefore essential that production wells withstand such pressures. Wells are being tested by installing a test plug down in the well, whereupon the well above the test plug is exposed to pressure from the boring and/or production unit at the surface. The well must withstand a certain amount of pressure without exhibiting any evidence of leakage. The test plug must withstand cyclic test pressure from above as well as the reservoir pressure from below. It is essential that the test plug withstands the pressure from the reservoir by a considerable margin. For instance, situations may arise where the pressure in the well becomes very low. In such a case, the pressure above the test plug may become very high, since there is no test pressure above the test plug which would fully or partly equalize the reservoir pressure.

Such circumstances put extreme demands on a test plug.

When well testing is completed, the test plug is to be removed so that the well is opened and production may begin. In this phase, the crushing phase, it is essential that the plug can be removed in a reliable manner.

Other scenarios where there is a need to install a removable plug in a piping are also conceivable. The present invention also relates to this kind of plugs.

Various plug arrangements used for testing of production wells or temporary blocking of piping are known. The most common approach has been to use metal plugs. The downside of this type of plugs is that they are (more) difficult to remove, thus often leading to scrap/residues remaining in the well which may lead to other problems at a later stage. There are also plugs of other materials, such as rubber etc., but these too have their downsides.

A glass plug may be manufactured with a single layer of glass or may comprise several glass layers, possibly with other materials in between the layers. Such materials may be solids, such as ceramics, plastics, felt or even cardboard, but they may also comprise gaseous or liquid fluids. Areas of vacuum may also be incorporated in the plug. In the present document, «glass» is to be understood as either one of single-layered or multilayered glass. It is also to be understood that making reference to «glass» may comprise other, similar materials, such as ceramic materials, i.e. materials having properties which match those of glass in the present context, in addition to other properties which also are desirable. A layer of glass may also be referred to as a glass plate or a glass disk. The glass plug is usually placed inside a housing, and additionally, there will be a need for an arrangement which is able to remove the plug. The housing may comprise a separate part or may be incorporated in a pipe section. Usually, glass will be used which is exposed to some sort of treatment, advantageously in order to make it stronger/tougher in the barrier phase and at the same time (more) easily crushable in the crushing phase. Such a treatment may e.g. comprise the treatment of the glass structure itself and/or of the glass surface.

Arrangements for removing the plug are usually built into or associated with the plug, meaning that they are installed together with or at the same time as the plug, either inside the plug itself or the housing or in connection with a pipe section. When the plug is to be removed, it is known to use explosive charges to crush the plug, usually by placing those inside the plug or on the surface thereof. This is prior art known from Norwegian Patent NO 321976. A number of disadvantages are attached to the installation and use of explosive charges in production wells. For instance, there is always a certain risk of explosives or parts thereof remaining undetonated inside the well, which is considered unacceptable by the user, despite the risk connected therewith being comparatively little. In addition, handling plugs with explosives during both transport (in particular cross-border) and installation as such is far more complicated due to the many safety precautions which must be taken, since the explosives pose a potential risk to users while handling the plug.

There are also crushing mechanisms based on mechanical solutions, e.g. spikes, pressure, hydraulic systems etc.

A solution which does not use explosives and is built in in a plug construction is to expose the plug to high localized pressure loads. This is shown in Norwegian patent application NO 20081229, where the arrangement for destroying the plug comprises a member arranged to move radially by guiding a release element in an axial direction, and in Norwegian Patent NO 331150, where locations which are exposed to such a large pressure load are weakened during the construction of the plug so as to be crushed more easily.

Another solution is to fill between a number of glass plates a fluid which is incompressible or only ever so slightly compressible and which is drained into a dedicated atmospheric chamber upon an opening signal. The plug elements will then collapse by means of the hydrostatic pressure. However, this will not work in case of a leakage in the atmospheric chamber, as the fluid cannot be drained. Another disadvantage of this solution is that the construction of the plug has to be weaker than what is desired, as the various plug members must be thin enough to burst by means of the well pressure only.

A similar solution is known from Norwegian Patent NO 328577, which presents a crushable plug comprising an inner cavity arranged to be in fluid communication with an external pressurizing member, and the plug being arranged so as to burst by supplying a fluid to the inner cavity such that the pressure inside the cavity exceeds the external pressure up to a level where the plug bursts.

From Norwegian patent NO 325431 there is known a crushable plug where the pressure differential between the outside and the inside of the plug is used to crush the plug in addition to a stud that puts the plug under a localized load. The inside pressure is discharged so as to achieve atmospheric pressure, while the outside pressure is equal to the hydrostatic pressure of the drill fluid at the current depth. Thus, in order to crush the plug, it is necessary that the pressure differential between the hydrostatic pressure of the drill fluid at the current depth and the atmospheric pressure is large enough.

An example of a release mechanism which does not comprise explosives is a so-called ticker solution. A release mechanism of this type functions by the mechanism counting a number of cyclic pressure changes, advantageously applied through the well from the surface, the mechanism being released and causing the glass to be crushed by means of any of the solutions described in the above.

An object of the present invention is to provide a plug which is not encumbered with one or more the above-mentioned disadvantages.

A further object is to present a plug which increases the strength of the plug, in particular from the reservoir side.

Next, it is an object to provide a plug which can be removed reliably when it is desirable or required.

In addition, or alternatively, it is an object to provide a plug which is simpler and cheaper to produce.

One or more of these objects are achieved by a solution as disclosed in claim 1. Further embodiments or advantages are disclosed in the dependent claims.

Figure 2:
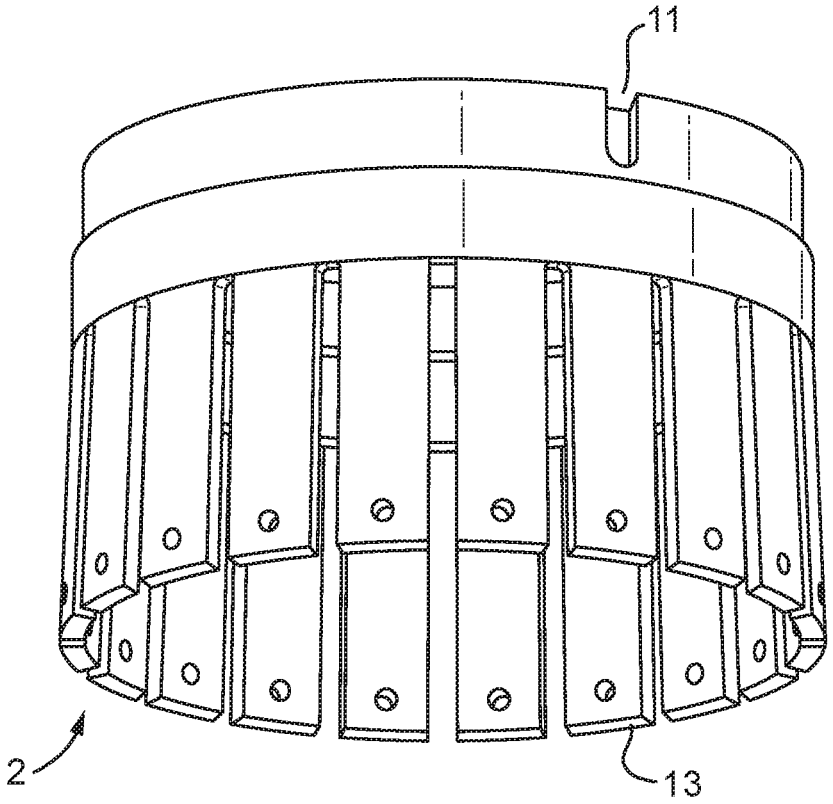
Figure 3:
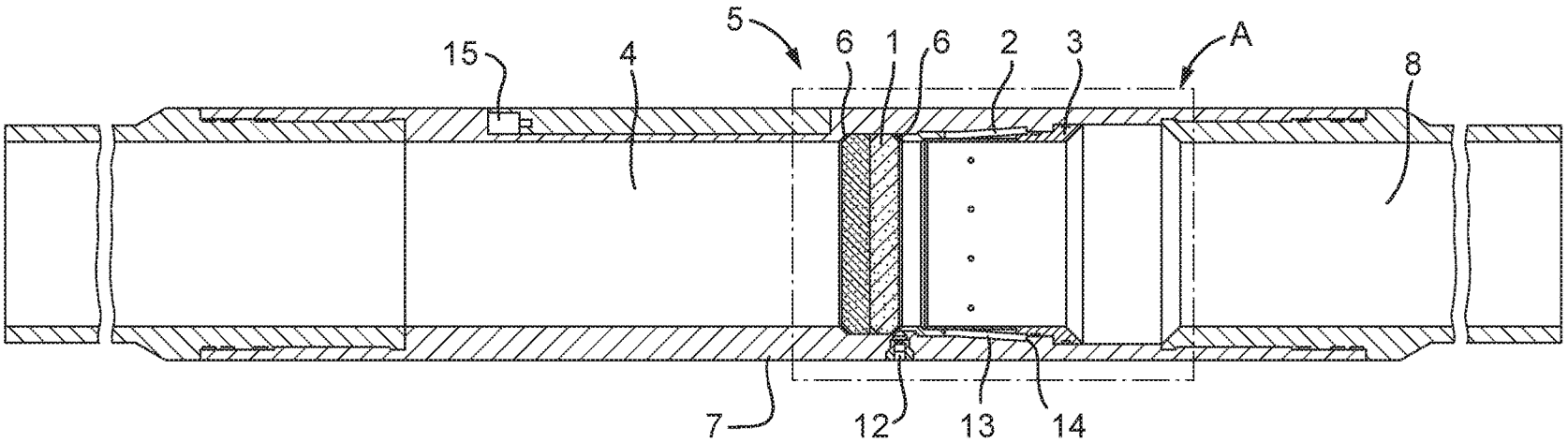
Figure 4:
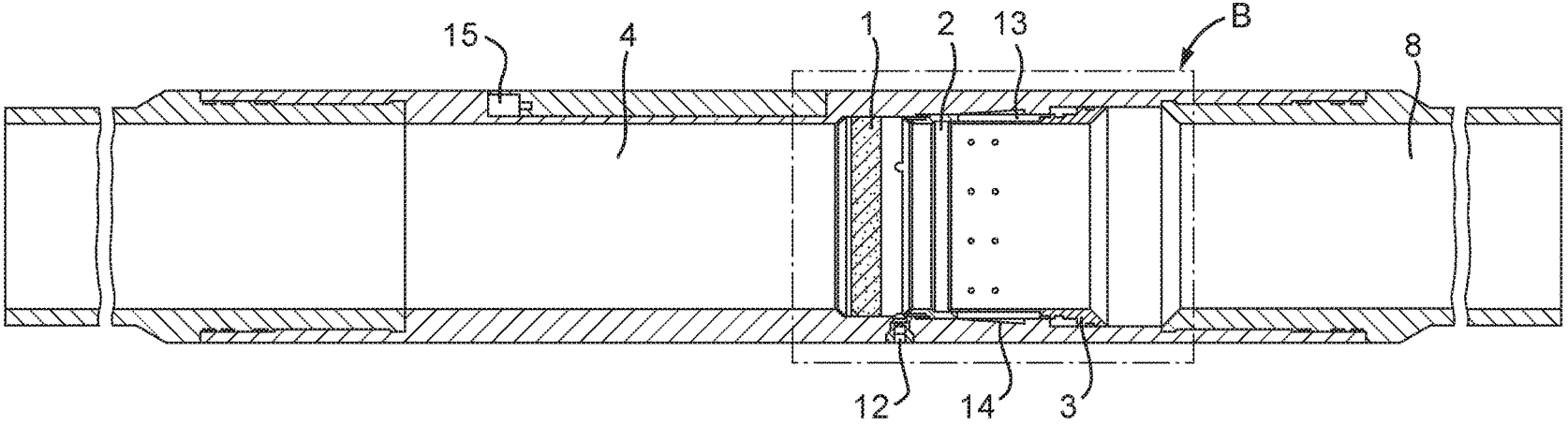
Figure 5:
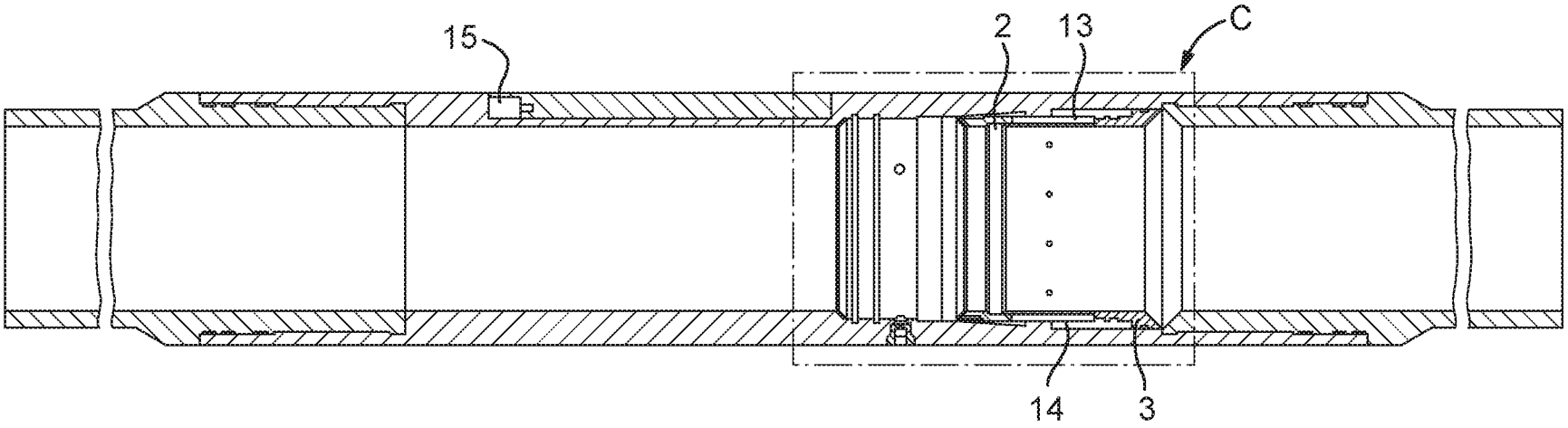
Figure 6:
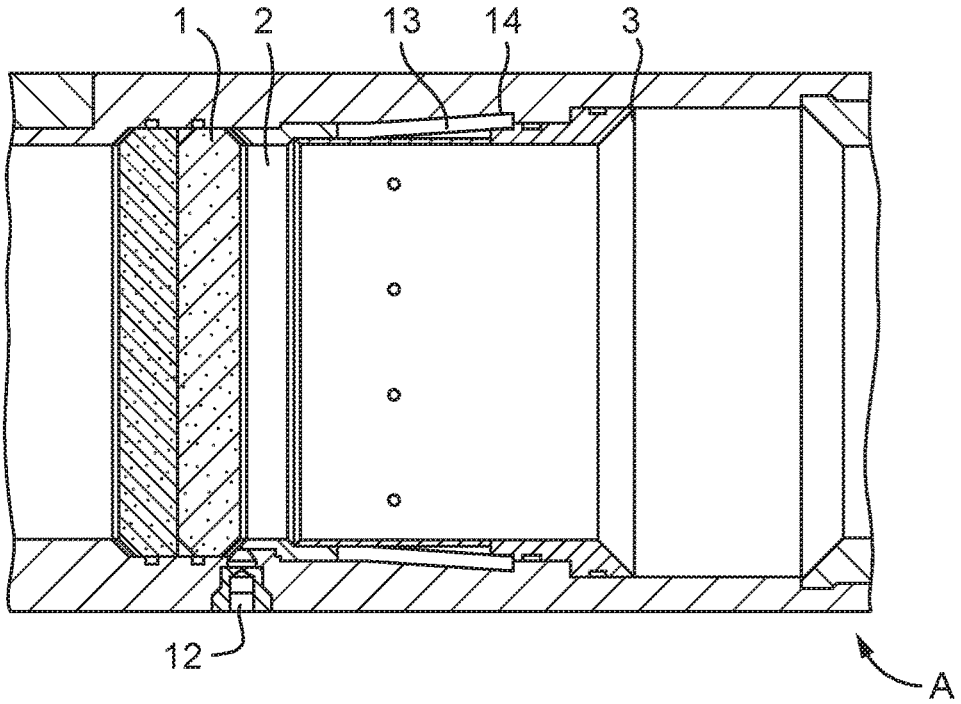
Figure 7:
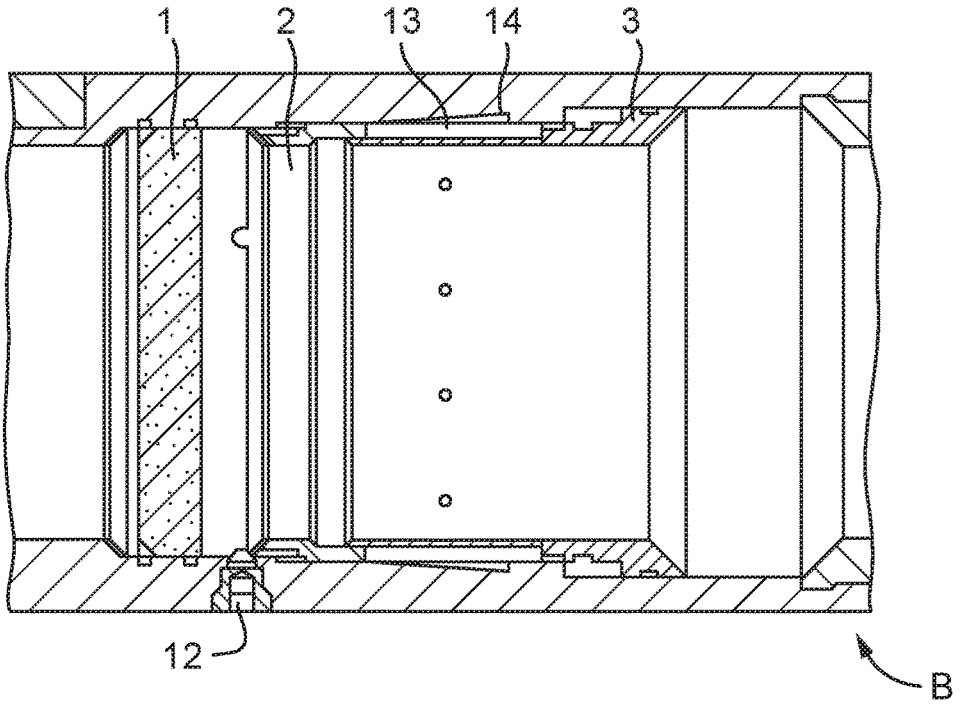
Figure 8:
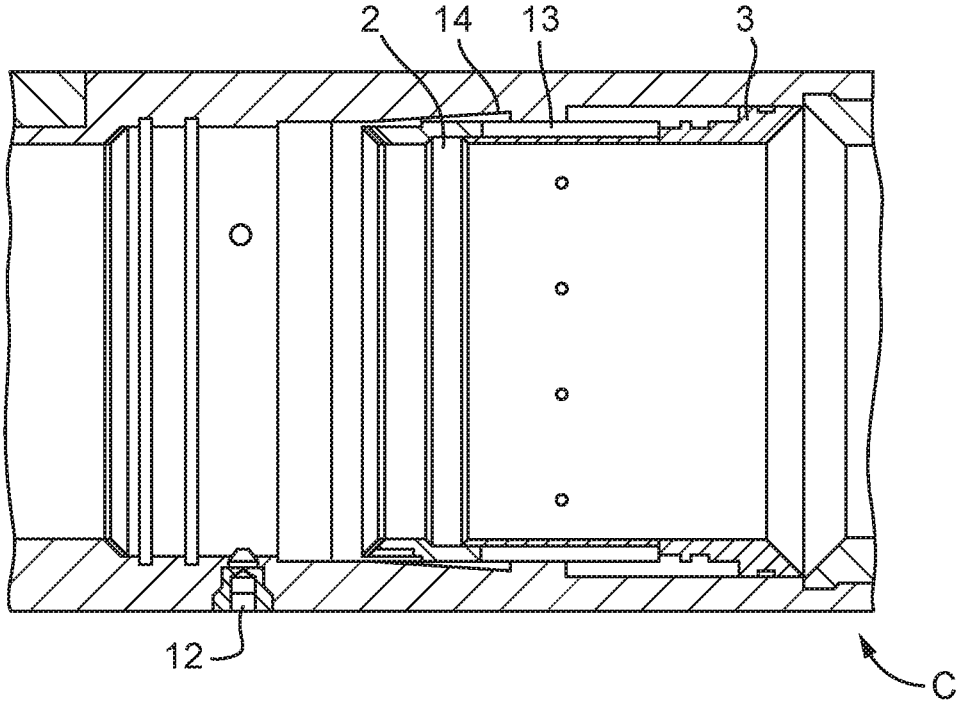

In the following, there is provided a detailed, yet non-limiting description of the invention with reference to the following figures, wherein:

FIG. 1 shows a sectional side view of an embodiment of a split sleeve according to the present invention, FIG. 2 shows a perspective view of the embodiment shown in FIG. 1, FIG. 3 shows an embodiment of the invention where the glass is installed and the arms of the split sleeve abut against the edge(s), FIG. 4 shows the same embodiment as FIG. 3, where the locking ring that holds the arms of the split sleeve against the edge(s) is freed as the glass is being crushed, FIG. 5 shows the same embodiment as in FIGS. 3 and 4, the glass having been crushed, and FIGS. 6-8 show details of FIGS. 3-5.

FIG. 3 shows an embodiment of the present invention comprising a glass 1, a split sleeve 2 and a locking ring 3. On the well side 4 of the plug 5, the glass 1 rests against one or more seats 6 which may be formed directly in the housing or the pipe section 7. This seat (or these seats) 6 form support members for the glass 1 on the well side 4 of the glass. According to this embodiment, it is a substantial advantage that none of the support members located on the well side comprise O-rings or other elements which may move, collapse or get stuck in case a situation arises where full pressure is exerted from the reservoir side 8. By this, the risk of development of potential leakage pathways is substantially reduced. This in turn contributes to giving the plug 5 as much strength from the reservoir side 8 as possible, which is the most essential function of a barrier plug.

Alternatively, the seat(s) may comprise one or more rings or sleeves abutting against one or more seats (not shown) which are formed directly in the housing 7, but in this case, the risk of development of potential leakage pathways around the glass 1 when full pressure hits from the reservoir side 8 is not avoided to the same extent.

On the other side of the glass 1, on the reservoir side 8, the split sleeve 2 is located. According to the embodiment shown, the split sleeve 2 forms one or more seats against the glass 1 in the form of a ring surface 9. This ring surface 9 may be straight or inclined. This is most clearly shown in FIGS. 1 and 2. The thickness of the ring surface in a radial direction may be adapted so as to achieve an abutment surface which provides the strength required/desired in a downward direction, plus a considerable margin. In the outer periphery 10 of the ring surface 9, a number of notches or slots 11 (one or more) may be present which may extend in an axial direction. In one or more of the notches or slots 11, a knife or stud 12 may be arranged which is arranged in the wall 7 of the housing, either directly or via other elements, possibly with sealing members in the form of O-rings or sealing members having some other type of design. This is to avoid the development of possible leakage pathways. The studs or knives 12 may also be milled or in any other way formed directly into the housing or possibly into an element arranged fully or partly around the glass and/or the sleeve element.

The studs or knives 12 will contribute to the crushing of the glass 1 in a crushing phase.

On the other end of the split sleeve 2, on the end facing downwards towards the reservoir 8, FIGS. 1 and 2 show a possible embodiment of the arms 13 of the split sleeve. In this context, the number and design of the arms 13 is not essential. The arms 13 of the split sleeve are formed so as to be able to be bent inwards (towards the center of the well) or outwards (towards the wall of the pipe). The arms 13 of the split sleeve are mounted so as to have the end of the arms (in a downward direction) abutting against an edge 14 located on the pipe/housing wall 7. To prevent the arms of the split sleeve from bending inwards towards the center of the well and thus being able to move freely downwards, a locking ring 3 is arranged at the inside of the arms of the split sleeve and may be arranged in such a way that during the crushing phase, it is displaced axially downwards and thus away from the arms 13 of the split sleeve. The arms 13 of the split sleeve will then be able to bend inwards (towards the center of the wall) and thus let go of the edge 14 and freely move downwards. The glass 1 will follow the split sleeve 2 and hit the knives/studs 12 with great force. If the glass 1 has not been broken yet, it will most definitely break upon hitting the knives/studs 12.

FIGS. 4 and 5 as well as 7 and 8 show how the locking ring 3 is displaced downwards so that the split sleeve 2 lets go of the edge 14, the glass 1 following the split sleeve and thus hitting the knives/studs 12. In FIGS. 5 and 8, the glass 1 has been crushed and washed away.

Other alternative embodiments for displacing the locking ring 3 downwards are conceivable.

It is conceivable that the locking ring 3 can free the split sleeve 2 by letting the locking ring go or displacing it in an upward direction (not shown). In this case, the arms 13 of the split sleeve and the locking ring 3 must be formed so as to be able to bend inwards even if the locking ring is displaced upwards towards the glass 1. At least, the locking ring must be let go upwards towards the glass to such an extent that the arms of the split sleeve are allowed to bend inwards more or less fully. In such an embodiment, the locking ring may be supported by a hydraulic fluid (not shown) which is discharged into one or more chambers when the plug is to be removed. Such a hydraulic support may also be used when the locking ring is arranged to be displaced downwards.

A further embodiment of the locking ring 3 may comprise a screwable solution, i.e. a locking ring that comprises external threads and moves away from the arms by being screwed downwards out of the engagement of the arms. By choosing the appropriate pitch number of the threads on the outside of the locking ring, the locking ring may become self-locking. In such an embodiment, the release mechanism will be arranged such that an internally threaded sleeve ring arranged at the outside of the threads of the locking ring, is made to rotate upon release, which may be achieved in a variety of ways.

When the locking ring 3 is located at the inside of the arms 13 of the split sleeve, the glass 1 is firmly arranged within the plug without the possibility of any substantial movement in an axial direction. The edge 14 will take up the force exerted by the glass via the split sleeve. The edge 14 may either be straight or inclined (possibly shaped otherwise). If it is inclined, it may contribute to pushing/bending the arms 13 inwards. The locking ring 3 will thus prevent the arms from being pushed/bent inwards when the split sleeve is locked as intended, while the arms 13 let go of the edge (more) easily when the locking ring 3 is freed/displaced.

The locking ring 3 may be freed/released in various ways.

One option is a mechanic or hydraulic connection with a ticker arrangement which is arranged in the wall of the pipe/housing on the upper side of the glass. When the ticker arrangement is released, the locking ring experiences a downward force which pushes it downwards away from the arms of the split sleeve, such that they bend inwards and thus free themselves from the edge. The split sleeve is thus free to move axially downwards.

Another option may be to arrange a so-called burst disk (not shown) in one more channels extending from the upper side of the plug down to the locking ring. When the burst disk is exposed so sufficiently high pressure, it will rupture and allow well fluid to pass through the channels, pushing the locking rings downwards. This hydraulic pressure may optionally be applied to the upper side of the locking ring via axially extending pins or other mechanic means which act as a lock in an upward direction, but may move substantially freely in a downward direction.

Such a mechanic transmission may also be combined which other release mechanisms 15, e.g. a ticker solution. The advantage of such a mechanic transmission is that it may act as a secure barrier towards the reservoir side in case the relative pressure from the lower side of the plug grows sufficiently large to rupture or damage a burst disk, ticker solution or other release mechanism that may be present from the lower side. A possible embodiment of such a mechanic transmission may be a pin (not shown) on the upper side abutting against a valve seat, i.e. the pin lies in a channel with a larger cross-section than the channel above the pin, the pin then being pushed against the valve seat and sealing the channel/connection when pressure is applied from the lower side. Such an embodiment will result in a plug which is «fail safe closed» both from the lower and from the upper side of the plug.

The split sleeve 2 according to another embodiment may be formed of several parts which are assembled so as to function in the way described in the above (not shown). The arms 13 may comprise e.g. fully or partly loose parts (arms) which support one or more support rings which support the glass. According to another embodiment, the arms may be collapsible either by being pushed inwards by means of appropriate means, or by the arms being made of a material or comprising weaknesses which collapse/break within a defined load interval.

The invention claimed is:

1. A plug arrangement comprising glass (1) arranged in a seat (6) in a plug housing, the seat (6) is one side of a support member for supporting the glass (1) in a longitudinal direction on an uphole side of the glass (1), wherein the support member further comprises a longitudinally displaceable split sleeve (2) for supporting the glass (1) on the reservoir side in the longitudinal direction, wherein the longitudinally displaceable split sleeve (2) comprises an annularly shaped support face (9) abutting against the glass (1) in one direction, and the longitudinally displaceable split sleeve (2) further comprises in the other direction a number of split sleeve arms (13) arranged to rest against an edge (14) arranged in the plug housing.

2. The plug arrangement according to claim 1, wherein the split sleeve arms (13) are arranged to bend inwards towards the center of the well.

3. The plug arrangement according to claim 1, wherein a longitudinally displaceable locking ring (3) is arranged to lock the arms (13) of the split sleeve against the edge.

4. The plug arrangement according to claim 3, wherein the longitudinally displaceable locking ring (3) is arranged to free the arms (13) of the split sleeve from the edge (14).

5. The plug arrangement according to claim 4, wherein a release mechanism (15) is arranged to displace the longitudinally displaceable locking ring (3) in the longitudinal direction.

6. The plug arrangement according to claim 5, wherein the longitudinally displaceable locking ring (3) is arranged to be displaced away from the glass (1).

7. The plug arrangement according to claim 5, wherein the longitudinally displaceable locking ring (3) is arranged to be displaced towards the glass (1).

8. The plug arrangement according to claim 5, wherein the release mechanism (15) is arranged to displace the locking ring (3) in an axial the longitudinal direction by means of a hydraulic force.

9. The plug arrangement according to claim 5, wherein the release mechanism (15) is arranged to displace the longitudinally displaceable locking ring (3) in the longitudinal direction by means of a mechanic force.

10. The plug arrangement according to claim 3, wherein a release mechanism (15) is arranged to displace the longitudinally displaceable locking ring (3) in the longitudinal direction.

11. The plug arrangement according to claim 10, wherein the displaceable locking ring (3) is arranged to be displaced away from the glass (1).

12. The plug arrangement according to claim 10, wherein the longitudinally displaceable locking ring (3) is arranged to be displaced towards the glass (1).

13. The plug arrangement according to claim 10, wherein the release mechanism (15) is arranged to displace the longitudinally displaceable locking ring (3) in the longitudinal direction by means of a hydraulic force.

14. The plug arrangement according to claim 10, wherein the release mechanism (15) is arranged to displace the longitudinally displaceable locking ring (3) in the longitudinal direction by means of a mechanic force.

15. The plug arrangement according to claim 10, wherein the release mechanism (15) is arranged to displace the longitudinally displaceable locking ring (3) in the longitudinal direction by means of a combination of a hydraulic and a mechanic force.

16. The plug arrangement according to claim 10, wherein the longitudinally displaceable locking ring (3) is supported by a hydraulic fluid, and the release mechanism (15) being arranged to discharge the hydraulic fluid.

17. The plug arrangement according to claim 10, wherein the longitudinally displaceable locking ring (3) has external threads.

18. The plug arrangement according to claim 17, wherein the pitch number of the external threads of the longitudinally displaceable locking ring (3) is chosen in such a way that the threaded connection is self-locking.

19. The plug arrangement according to claim 1, wherein the longitudinally displaceable split sleeve (2) is integrally formed.

20. The plug arrangement according to claim 1, wherein the longitudinally displaceable split sleeve (2) is formed in multiple parts.

21. A pipe section comprising a plug arrangement located inside of the pipe section, the plug arrangement comprising glass (1) arranged in a seat (6) in a plug housing, the seat (6) is one side of a support member for supporting the glass (1) in a longitudinal direction on an uphole side of the glass (1), wherein the support member further comprises a longitudinally displaceable split sleeve (2) for supporting the glass (1) on the reservoir side in the longitudinal direction, wherein the longitudinally displaceable split sleeve (2) comprises an annularly shaped support face (9) abutting against the glass (1) in one direction, and the longitudinally displaceable split sleeve (2) further comprises in the other direction a number of split sleeve arms (13) arranged to rest against an edge (14) arranged in the plug housing.

22. The pipe section according to claim 21, wherein the seat is arranged within an inner wall of the pipe section.

23. The pipe section according to claim 21, wherein the split sleeve arms (13) are arranged to bend inwards towards the center of the well.

24. The pipe section according to claim 21, wherein a longitudinally displaceable locking ring (3) is arranged to lock the arms (13) of the split sleeve against the edge.

25. The pipe section according to claim 24, wherein the longitudinally displaceable locking ring (3) is arranged to free the arms (13) of the split sleeve from the edge (14).

26. The pipe section according to claim 25, wherein a release mechanism (15) is arranged to displace the longitudinally displaceable locking ring (3) in the longitudinal direction.

27. The pipe section according to claim 24, wherein a release mechanism (15) is arranged to displace the longitudinally displaceable locking ring (3) in the longitudinal direction.

* * * * *